US006662387B2

(12) United States Patent
Winzar

(10) Patent No.: US 6,662,387 B2
(45) Date of Patent: Dec. 16, 2003

(54) WATER TRAP

(76) Inventor: Duncan P. Winzar, 12 Grimsdyke crt, Ashmore Queensland 4214 (AT)

( * ) Notice: Subject to any disclaimer, the term of this patent is extended or adjusted under 35 U.S.C. 154(b) by 0 days.

(21) Appl. No.: 10/179,900

(22) Filed: Jun. 26, 2002

(65) Prior Publication Data

US 2003/0005516 A1 Jan. 9, 2003

Related U.S. Application Data

(63) Continuation-in-part of application No. 09/698,045, filed on Oct. 30, 2000, now abandoned.

(51) Int. Cl.[7] ..... E03C 1/12
(52) U.S. Cl. ..... 4/679; 4/650; 137/247.39
(58) Field of Search ..... 4/679, 650, 653; 137/247.35, 247.33, 347.39

(56) References Cited

U.S. PATENT DOCUMENTS

| | | | | |
|---|---|---|---|---|
| 367,686 A | 8/1887 | Warden | ..... | 137/247.35 |
| 875,587 A | 12/1907 | Morrison | ..... | 137/247.35 |
| 904,286 A | 11/1908 | Waibel | ..... | 137/247.35 |
| 3,725,964 A | 4/1973 | Whitsett | | |

FOREIGN PATENT DOCUMENTS

| | | |
|---|---|---|
| GB | 2296514 | 7/1996 |
| GB | 2298661 | 9/1996 |
| WO | 91/12379 | 8/1991 |

*Primary Examiner*—John Rivell
*Assistant Examiner*—Kathleen J. Prunner
(74) *Attorney, Agent, or Firm*—Hoffman, Wasson & Gitler

(57) ABSTRACT

A water trap comprising a cylindrical outer casing having a flat top wall and a frustoconical bottom wall, an internal substantially semi-circular open topped water seal container within the outer casing, an inlet into the water seal container which passes through the top wall and abuts one side wall of the water seal container and extends thereinto, and an outlet from the bottom wall of the trap that is offset from, and co-linear with, the inlet. The cross-sectional areas within the trap progressively increase to promote water flow through the trap.

1 Claim, 3 Drawing Sheets

WATER TRAP

RELATED APPLICATION

The instant application is a continuation-in-part application based upon U.S. patent application Ser. No. 09/698,045, filed Oct. 30, 2000, and now abandoned.

BACKGROUND OF THE INVENTION

Water traps are used to connect water receptacles with drains and sewers.

The most common type of trap is what is known as a S-bend trap.

Where there is adequate room, S-bend traps are readily installed and dismantled for maintenance purposes but where there is limited room, for example, where the trap is required to be installed in a pedestal or other form of shroud, installation becomes a difficult exercise.

In-line or so called "bottle traps" have been proposed in the past in an effort to facilitate ease of installation and maintenance.

U.S. Pat. No. 3,725,964 describes an in-line trap having an inlet, an outlet, and an open top water seal container in a substantially concentric arrangement. The main objective of the inventor was not to minimize size, but to provide a structure which, it is said, can be readily dismantled for maintenance purposes. The trap described appears to be designed exclusively for a kitchen sink and would not be suitable for fitment to smaller diameter basin waste pipes, nor would it be readily adapted to retro-fitment to existing installations.

It is an object of the present invention to provide a water trap which is compact and can be produced to suit numerous installation requirements, particularly those where space is at a premium.

An orderly flow of water through water traps is highly desirable.

Any structure and arrangement of a trap which creates excessive syphoning as water passes through the trap is likely to drain out to below a satisfactory, or prescribed minimum, volume of entrapped water.

A further object of the present invention is to provide a water trap which promotes an orderly flow pattern of fluids passing through the trap and a controlled level of syphoning from the trap.

Further objects and advantages of the present invention will become apparent in the ensuing description.

BRIEF SUMMARY OF THE INVENTION

According to the present invention there is provided a water trap comprising a substantially cylindrical outer casing having a flat top wall, a side wall and a frustoconical bottom wall, and an internal substantially semicircular open topped water seal container within the outer casing which occupies a half segment of the outer casing thus defining a second half segment region, the water seal container having a flat base and a top edge which terminates below the top wall of the outer casing defining a space between the top edge and the flat top wall of the casing, an inlet into the water seal container which passes through the flat top wall of the casing, abutting a side wall of the water seal container and terminating in close proximity to the flat base of the water seal container, the cross-sectional area of the inlet being constant over its length, an outlet from the frustoconical bottom wall of the outer casing which is offset and co-linear with the inlet, the inlet having a sink connecting nut and the outlet having an external O-ring seal, the invention characterized in that the cross-sectional areas of the inlet, water seal container excluding the inlet, the space above the top edge of the water seal container, and the region between the water seal container and the outer casing, progressively increase to assist water flow through the trap.

The axis of the outlet can be off set in relation to the axis of the outer casing.

The inlet can be fitted with a standard sink connecting nut.

The outlet can be provided with an external O-ring seal.

Elements of the trap can have the following cross-sectional areas (C.S.A.).

| | ELEMENT | C.S.A. |
|---|---|---|
| A. | Inlet | Approx. 881 $mm^2$ |
| B. | Space directly below inlet | Approx. 1022 $mm^2$ |
| C. | Water seal container (less region A) | Approx. 997 $mm^2$ |
| D. | Water passage | Approx. 1147 $mm^2$ |
| E. | Trap casing (less region C) | Approx. 1985 $mm^2$ |

The body has a frustoconical portion preceding the outlet.

BRIEF DESCRIPTION OF THE DRAWINGS

Aspects of the present invention will now be described with reference to the accompanying drawings in which.

DETAILED DESCRIPTION

Figure 1:
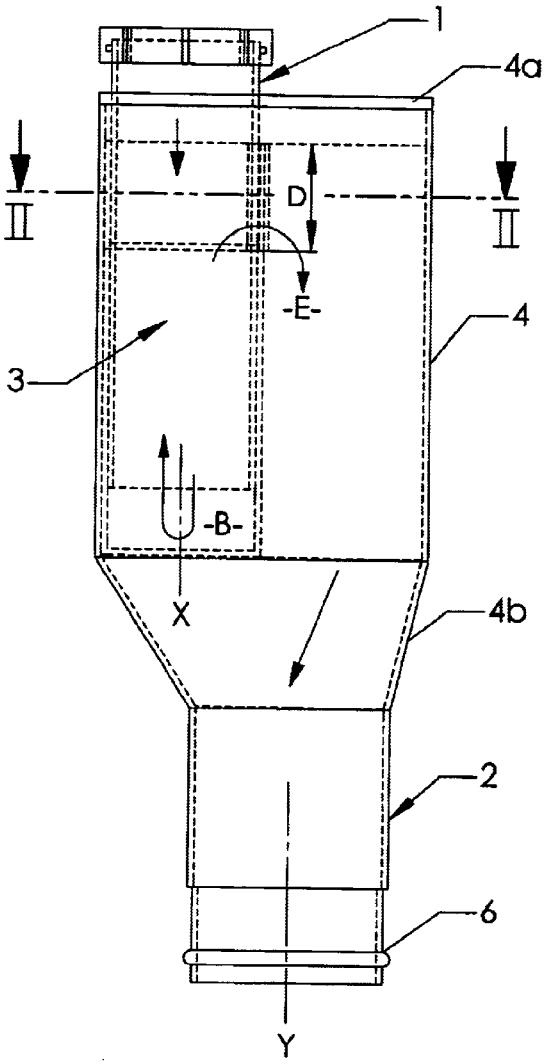
FIG. 1 is a side view of a water trap in accordance with one possible embodiment of the present invention.

A trap in accordance with the illustrated embodiment can comprise an inlet, and outlet and a water seal container generally illustrated by arrows 1, 2 and 3, respectively.

Outer casing 4 is cylindrical and supports the water seal container 3 and provides the outlet 2. The inlet 1 extends into the water seal container via a removable flat top wall 4*a* of the casing 4.

The inlet 1 can be fitted with a standard size connecting nut with an O-ring seal 6.

The longitudinal axes X and Y respectively of the inlet and water seal container 3 are off-set with respect to each other.

To assist water flow and to prevent undesirable siphoning the inlet 1, water seal container 3 and casing 4 are of increasing cross-sectional area in the direction of water flow indicated by the path arrows of FIG. 1.

This, along with a frustoconical bottom wall 4*b* of the casing 4 prior to the outlet 2, encourages vortexing at the outlet and the entry of air into upper portions of the casing 4 of the trap breaking the syphoning affect which would otherwise occur when a large volume of water is released into the trap. If a "siphon" action occurs, the quantity of trapped water can be diminished to the extent that the trap does not meet desirable or regulatory requirements.

Elements of the trap can have the following cross-sections areas (C.S.A.), in the regions A to E indicated on the drawings.

| | ELEMENT | C.S.A. |
|---|---|---|
| A. | Inlet | Approx. 881 $mm^2$ |
| B. | Space directly below inlet | Approx. 1022 $mm^2$ |
| C. | Water seal container (less region A) | Approx. 997 $mm^2$ |
| D. | Water passage | Approx. 1147 $mm^2$ |
| E. | Trap casing (less region C) | Approx. 1985 $mm^2$ |

The inlet 1 and outlet 2 can be Selected from various diameters to suit particular installation requirements, as may the water seal container 3 and outer casing 4.

The trap illustrated can be made in a very compact form to suit situations where the installation space is minimal.

The offset inlet allows the trap to be fitted to a basin whose pedestal is as close as 40 mm from the front edge of the waste outlet.

Overall width of the outer casing can be as small as 76 mm making it small enough to be concealed in most pedestals.

The water seal container can be spaced from the frustoconical bottom wall and sides of the outer casing 4 by spacers (not shown) or can be fixed to, or part of, the casing.

Figure 2:
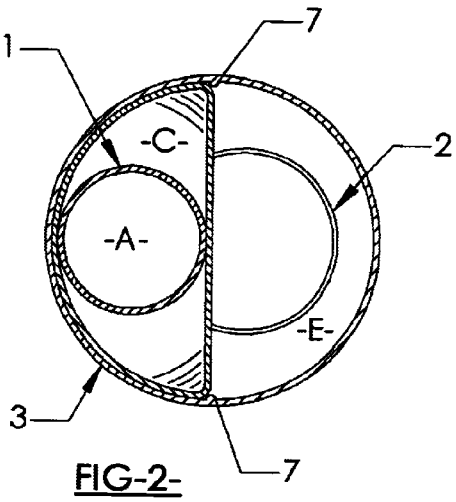
FIG. 2 is a sectional view of the trap of FIG. 1 taken along line II—II in FIG. 1, and FIGS. 3 and 4 show water traps according to the present invention installed in a pedestal basin and bidet, respectively.

In the illustrated instance the water seal container 3 is of a semi-circular cross-section and is secured in its current position by ribs 7. The water seal container 3 can be a unitary member as illustrated or be formed by the placement of a central wall and base member. The lower internal surfaces at the corners of the water seal container can be provided with curved surfaces indicated by the shading on FIG. 2 to assist water flow.

The provision of a push fit "O-ring seal" 6 means that the trap can be connected to a basin first then can be lowered onto the basin pedestal and the waste outlet simultaneously to complete the fitting to the waste pipe without needing to fit nuts or flanges or the like inside the pedestal where the access for tools is minimal and where there is only slightly more room for an installer's hands.

Because the cross-sectional areas of the inlet, water seal container excluding the inlet, the space above the top edge of the water seal container, and the region between the water seal container and the outer casing Progressively increase in the direction of water flow to the outlet, the likelihood of residual build up or blockage is also minimized. The trap resists blockage and build up.

The Position of the bottom of the inlet 1 above the base of the water seal container in region B is predetermined to maximize the efficiency of the trap and should be between 10 and 11 mm.

Figure 4:
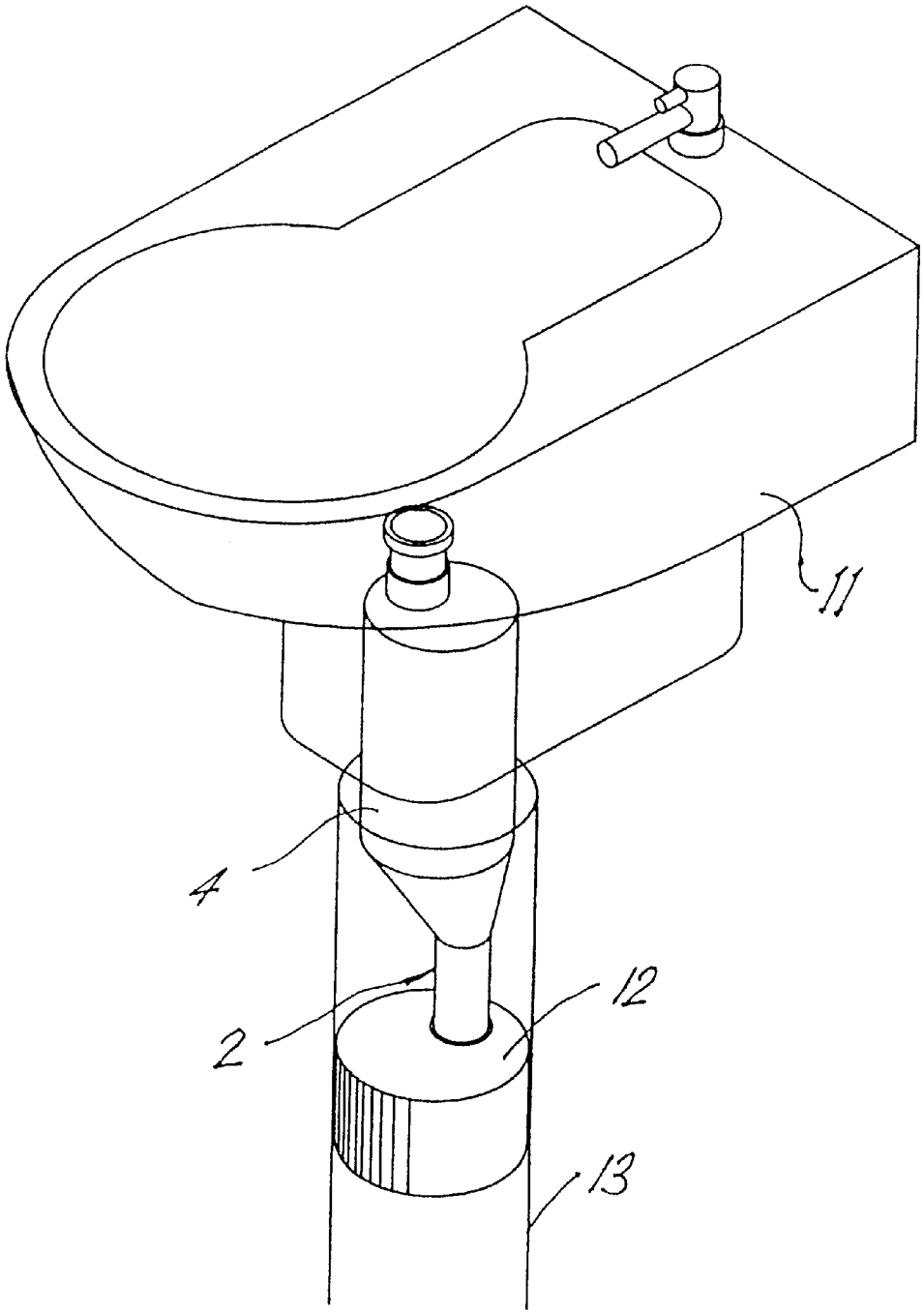

FIGS. 4 and 5 of the drawings illustrate the trap installed in a pedestal basin and bidet, respectively.

Figure 3:
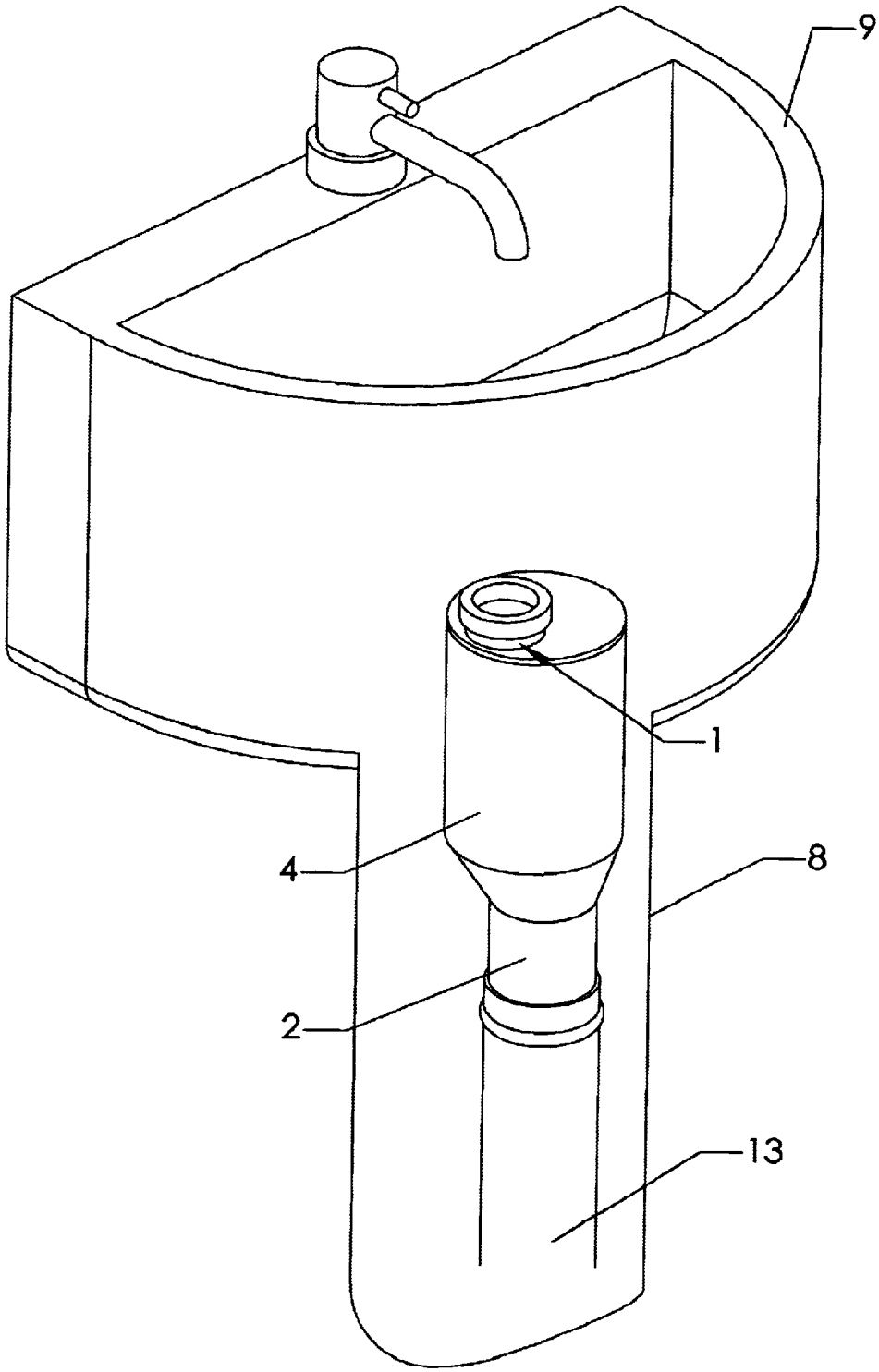

In FIG. 3 the trap is shown positioned within the pedestal 8 of a hand basin 9 with the outlet 2 feeding directly to waste pipe 13.

In FIG. 4 of the drawings the trap is shown positioned beneath a bidet 11 with the outlet 2 connected to a pipe reducer 12 housed within the waste pipe 13.

Since the center line of the outlet is offset from the main body by 7 mm, this gives a center to side measurement of 33 mm. When a standard 50×40 eccentric reducer is glued into a standard 100×50 eccentric pipe reducer, it has a center to side measurement of approximately 55 mm. This would mean when the trap is used in conjunction with the reducers it will slide into a 100 mm diameter PVC pipe without interfering with the sides. This allows the trap to be used under bidets and bidettes if the drains are prepared in 100 mm PVC. The trap would be fitted to the fixture first and then lowered over the pipe and reducer, with half of the trap resting below the finished floor level inside the 100 mm pipe. The reducers would seal the drain approximately 110 mm below the finished floor level.

Aspects of the present invention have been described by way of example only and it should be appreciated that modifications and additions may be made thereto without departing from the scope of the invention as defined in the appended claims.

What is claimed is:

1. A water trap comprising:

a. a substantially cylindrical outer casing having a flat top wall, a side wall and a frustoconical bottom wall, and b. an internal substantially semi-circular open topped water seal container within the outer casing which occupies a half segment of the outer casing thus defining a second half segment region, the water seal container having a flat base and a top edge which terminates below the top wall of the outer casing defining a space between the top edge and the flat top wall of the casing, c. an inlet into the water seal container which passes through the flat top wall of the casing, abutting a side wall of the water seal container and terminating in close proximity to the flat base of the water seal container, the cross-sectional area of the inlet being constant over its length, d. an outlet from the frustoconical bottom wall of the outer casing which is offset and co-linear with the inlet, e. the inlet having a sink connecting nut and the outlet having an external O-ring seal, f. the invention characterized in that the cross-sectional areas of the inlet, water seal container excluding the inlet, the space above the top edge of the water seal container, and the region between the water seal container and the outer casing, progressively increase to assist water flow through the trap.

* * * * *